US010267086B2

(12) United States Patent
Vander Bent

(10) Patent No.: US 10,267,086 B2
(45) Date of Patent: Apr. 23, 2019

(54) IMPACT-RESISTANT FENESTRATION WITH OFFSET DUAL PANE INSULATED GLASS UNIT

(71) Applicant: PGT, Inc., Nokomis, FL (US)

(72) Inventor: Ken Vander Bent, Bradenton, FL (US)

(73) Assignee: PGT Innovations, Inc., Wilmington, DE (US)

( * ) Notice: Subject to any disclaimer, the term of this patent is extended or adjusted under 35 U.S.C. 154(b) by 0 days.

(21) Appl. No.: 15/279,100

(22) Filed: Sep. 28, 2016

(65) Prior Publication Data

US 2018/0087316 A1 Mar. 29, 2018

(51) Int. Cl.
*E06B 3/66* (2006.01)
*E06B 5/10* (2006.01)

(52) U.S. Cl.
CPC ..... *E06B 5/10* (2013.01); *E06B 3/6617* (2013.01); *E06B 5/103* (2013.01)

(58) Field of Classification Search
CPC ..... E06B 5/10; E06B 3/6617; E06B 3/673; E06B 3/6715; E06B 3/6621
USPC ... 52/204.5, 204.62, 204.53, 204.54, 204.57, 52/204.593, 204.595, 204.597, 204.6, 52/204.71; 49/504
See application file for complete search history.

(56) References Cited

U.S. PATENT DOCUMENTS 2,205,522 A * 6/1940 Fix ..... E06B 3/28 52/203
5,653,073 A * 8/1997 Palmer ..... E06B 3/64 52/204.593
5,937,611 A * 8/1999 Howes ..... B32B 17/10036 156/99
6,055,783 A * 5/2000 Guhl ..... C03C 27/06 156/109
6,101,783 A * 8/2000 Howes ..... B32B 17/10036 52/204.69
6,546,692 B1 * 4/2003 Duncan ..... B32B 17/10018 52/786.11
6,886,297 B1 * 5/2005 Crandell ..... E06B 3/64 52/172
7,258,757 B2 * 8/2007 Huang ..... B32B 17/10009 156/107

(Continued)

*Primary Examiner* — Brent W Herring
(74) *Attorney, Agent, or Firm* — Pepper Hamilton LLP

(57) ABSTRACT

Embodiments can provide an impact-resistant fenestration comprising an offset dual-pane insulated glass unit, comprising a small pane; a large pane, wherein the large pane has a greater surface area than the small pane; a layer of impact-resistant film attached to either the large pane or the small pane; wherein the small pane and the large pane are secured together using an insulated glass spacer to create an airspace between the small pane and large pane; and wherein the small pane is centrally secured on the large pane to create an overhang section; a tiered frame comprising an overhang mount and a tiered mount; and a glass stop; wherein the offset dual-pane insulated glass unit is mounted into the tiered frame such that the overhang section of the offset dual-pane insulated glass unit is secured to the overhang mount of the tiered frame using a layer of overhang adhesive, the small pane of the offset dual-pane insulated glass unit is secured to the standard mount of the tiered frame using a layer of standard adhesive, and the glass stop attaches to the overhang section and the tiered frame.

17 Claims, 9 Drawing Sheets

(56) References Cited

U.S. PATENT DOCUMENTS 7,296,388 B2 * 11/2007 Valentz ..... E04D 13/0315 52/200
7,490,445 B2 * 2/2009 Steffek ..... E06B 3/24 156/109
7,588,653 B2 * 9/2009 Crandell ..... E06B 3/24 156/109
7,762,028 B2 * 7/2010 Valentz ..... E04D 13/0305 52/200
7,997,037 B2 * 8/2011 Crandell ..... E06B 3/24 52/172
8,291,674 B2 * 10/2012 Valentz ..... E04D 13/0315 428/34
8,377,524 B2 * 2/2013 Theios ..... E06B 3/6612 428/213
8,789,324 B2 * 7/2014 Hay ..... E06B 3/24 52/202
8,900,679 B2 * 12/2014 Theios ..... E06B 3/6612 428/34
9,797,140 B1 * 10/2017 Conklin ..... E04D 13/0315
9,920,532 B1 * 3/2018 Conklin ..... E06B 3/663
2004/0231255 A1 * 11/2004 Silverman ..... E06B 3/24 52/204.6
2005/0028459 A1 * 2/2005 Crandell ..... E06B 3/24 52/204.5
2005/0028460 A1 * 2/2005 Steffek ..... E06B 3/24 52/204.5
2005/0034386 A1 * 2/2005 Crandell ..... E06B 3/24 52/204.5
2006/0090834 A1 * 5/2006 Huang ..... B32B 17/10009 156/99
2006/0101737 A1 * 5/2006 Platz ..... B32B 17/10036 52/204.5
2008/0118678 A1 * 5/2008 Huang ..... B32B 17/10009 428/34
2008/0196317 A1 * 8/2008 Duncan ..... E06B 5/10 49/506
2008/0256896 A1 * 10/2008 Lisec ..... E06B 3/308 52/786.1
2009/0229216 A1 * 9/2009 Duncan ..... E06B 5/10 52/745.2
2010/0186641 A1 * 7/2010 Hay, III ..... E06B 3/24 109/76
2010/0275537 A1 * 11/2010 Valentz ..... E04D 13/0305 52/200
2014/0326126 A1 * 11/2014 Hay, III ..... E06B 3/24 89/36.04

* cited by examiner

IMPACT-RESISTANT FENESTRATION WITH OFFSET DUAL PANE INSULATED GLASS UNIT

TECHNICAL FIELD

The present application relates generally to an impact-resistant fenestration with an offset dual-pane insulated glass unit and a method for its manufacture.

BACKGROUND

Impact-resistant fenestrations are a necessity in areas prone to hurricanes and other weather that generate high winds. While the winds themselves do not typically cause damage to glass windows or doors, in severe weather, loose objects can become airborne and be propelled at dangerous speeds. Once one or more glass windows or doors are breached in a building, it is common that the building's roof and general structure will be heavily damaged. This is particularly prevalent in single or double floor homes, where the primary structure is wood-based.

Several solutions for impact-resistant glass have been created, but suffer from significant drawbacks. Glass panes with excessive thickness are too heavy, and can stress a structural frame. Lack of insulation can lead to cumulative energy loss that can lead to unmanageable energy bills. Improper framing can reduce the structural integrity of the window unit as a whole. What is needed is a structurally sound, energy efficient, impact-resistant fenestration with the capability to withstand high impacts without breaching.

SUMMARY

Embodiments can provide an impact-resistant fenestration comprising an offset dual-pane insulated glass unit, comprising a small pane; a large pane, wherein the large pane has a greater surface area than the small pane; a layer of impact-resistant film attached to the large pane; wherein the small pane and the large pane are secured together using an insulated glass spacer to create an airspace between the small pane and large pane; and wherein the small pane is centrally secured on the large pane to create an overhang section; a tiered frame comprising an overhang mount and a tiered mount; and a glass stop; wherein the offset dual-pane insulated glass unit is mounted into the tiered frame such that the overhang section of the offset dual-pane insulated glass unit is secured to the overhang mount of the tiered frame using a layer of overhang adhesive, the small pane of the offset dual-pane insulated glass unit is secured to the standard mount of the tiered frame using a layer of standard adhesive, and the glass stop attaches to the overhang section and the tiered frame.

Embodiments can further provide an impact-resistant fenestration further comprising a layer of LowE material attached to the layer of impact-resistant film such that the LowE material is disposed between the layer of impact-resistant film and the airspace.

Embodiments can further provide an impact-resistant fenestration further comprising a second layer of impact-resistant film attached to the small pane.

Embodiments can further provide an impact-resistant fenestration further comprising a layer of LowE material attached to the second layer of impact-resistant film such that the LowE material is disposed between the second layer of impact-resistant film and the airspace.

Embodiments can further provide an impact-resistant fenestration wherein the layer of impact-resistant film comprises at least one of polyurethane, polyvinyl butyral, or polyethylene terephthalate (PET), ionoplast, liquid resin, epoxy-liquid crystal polymers, and a combination thereof.

Embodiments can further provide an impact-resistant fenestration wherein the layer of overhang adhesive and the layer of standard adhesive comprise at least one of glue, silicone, polyurethane, tape, epoxy, and a combination thereof.

Embodiments can provide an impact-resistant fenestration comprising an offset dual-pane insulated glass unit, comprising a small pane; a large pane, wherein the large pane has a greater surface area than the small pane; a layer of impact-resistant film attached to the small pane; wherein the small pane and the large pane are secured together using an insulated glass spacer to create an airspace between the small pane and large pane; and wherein the small pane is centrally secured on the large pane to create an overhang section; a tiered frame comprising an overhang mount and a tiered mount; and a glass stop; wherein the offset dual-pane insulated glass unit is mounted into the tiered frame such that the overhang section of the offset dual-pane insulated glass unit is secured to the overhang mount of the tiered frame using a layer of overhang adhesive, the small pane of the offset dual-pane insulated glass unit is secured to the standard mount of the tiered frame using a layer of standard adhesive, and the glass stop attaches to the overhang section and the tiered frame.

Embodiments can further provide an impact-resistant fenestration further comprising a layer of LowE material attached to the layer of impact-resistant film such that the LowE material is disposed between the layer of impact-resistant film and the airspace.

Embodiments can further provide an impact-resistant fenestration further comprising a second layer of impact-resistant film attached to the large pane.

Embodiments can further provide an impact-resistant fenestration further comprising a layer of LowE material attached to the second layer of impact-resistant film such that the LowE material is disposed between the second layer of impact-resistant film and the airspace.

Embodiments can further provide an impact-resistant fenestration wherein the layer of impact-resistant film comprises at least one of polyurethane, polyvinyl butyral, or polyethylene terephthalate (PET), ionoplast, liquid resin, epoxy-liquid crystal polymers, and a combination thereof.

Embodiments can further provide an impact-resistant fenestration wherein the layer of overhang adhesive and the layer of standard adhesive comprise at least one of glue, silicone, polyurethane, tape, epoxy, and a combination thereof.

Embodiments can provide a method for manufacturing an impact-resistant fenestration, comprising assembling an offset dual-pane insulated glass unit, comprising applying a layer of impact-resistant film attached to a large pane having a greater surface area than a small pane; and securing the small pane centrally on the large pane to create an overhang section using an insulated glass spacer to create an airspace between the small pane and large pane; mounting the offset dual-pane insulated glass unit on a tiered frame, comprising: securing the overhang section of the offset dual-pane insulated glass unit to an overhang mount of the tiered frame using a layer of overhang adhesive; and securing the small pane of the offset dual-pane insulated glass unit to a standard mount of the tiered frame using a layer of standard adhesive; and attaching a glass stop to the overhang section and the tiered frame.

Embodiments can further provide a method further comprising applying a layer of LowE material to the layer of impact-resistant film such that the LowE material is disposed between the layer of impact-resistant film and the airspace.

Embodiments can further provide a method further comprising applying a second layer of impact-resistant film attached to the small pane.

Embodiments can further provide a method further comprising applying a layer of LowE material to the second layer of impact-resistant film such that the LowE material is disposed between the second layer of impact-resistant film and the airspace.

Embodiments can further provide a method wherein the layer of impact-resistant film comprises at least one of polyurethane, polyvinyl butyral, or polyethylene terephthalate (PET), ionoplast, liquid resin, epoxy-liquid crystal polymers, and a combination thereof.

Embodiments can further provide a method wherein the layer of overhang adhesive and the layer of standard adhesive comprise at least one of glue, silicone, polyurethane, tape, epoxy, and a combination thereof.

Embodiments can further provide a method further comprising installing the impact-resistant fenestration into a structure element such that the large pane of the impact-resistant fenestration faces outside.

Additional features and advantages of this disclosure will be made apparent from the following detailed description of illustrative embodiments that proceeds with reference to the accompanying drawings.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings embodiments that are presently preferred, it being understood, however, that the invention is not limited to the specific instrumentalities disclosed. Included in the drawings are the following Figures.

DETAILED DESCRIPTION OF EXEMPLARY EMBODIMENTS

The impact-resistant fenestration with offset dual-pane insulated glass unit (IGU) can be constructed from two separated panes of glass, where one pane of glass can have larger dimensions than the other pane of glass. As used herein, a fenestration can include, but is not limited, a glass window, a door with a glass window, and a glass doors. One or more of the panes of glass can be coated with an impact-resistant film. In an embodiment, at least one of the panes of glass can be coated with a low emission (LowE) or tinted coating. The two panes of glass can be sealed into a single offset dual-pane insulated glass unit (IGU) through the use of an insulated glass spacer and adhesives. The two panes of glass are adhered to each other such that the smaller pane of glass is centered within the boundaries of the larger pane of glass, which creates an overhang onto which the fenestration frame, vent, or sash can be adhered. By using an impact-resistant film, and by mounting the IGU into the fenestration frame so that the overhang presses into the frame, the impact-resistant fenestration can deflect and remain intact even in high force impact situations. One of the primary benefits of this invention can be the processing benefits of a film verses a laminated impact glass unit. This film/laminate does not require an autoclave batch process, which can significantly increase the manufacturing efficiency of hurricane resistant glazing.

Figure 1:
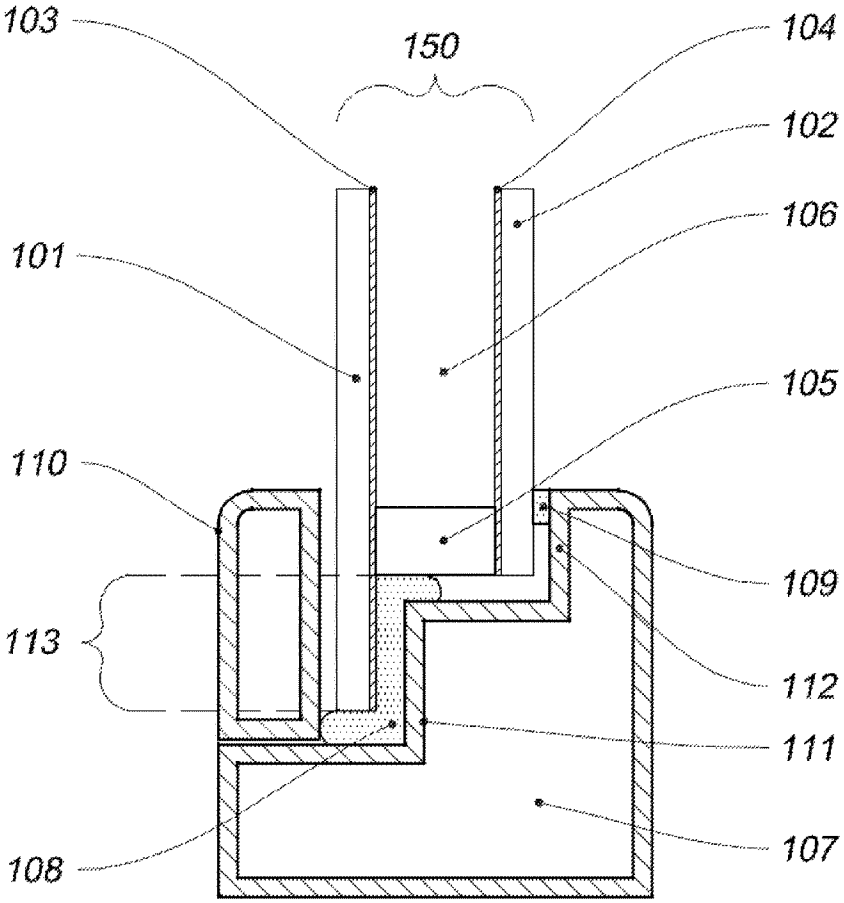
FIG. 1 depicts a cross-section view of an impact-resistant fenestration with offset dual-pane insulated glass unit, according to embodiments described herein.
Figure 2:
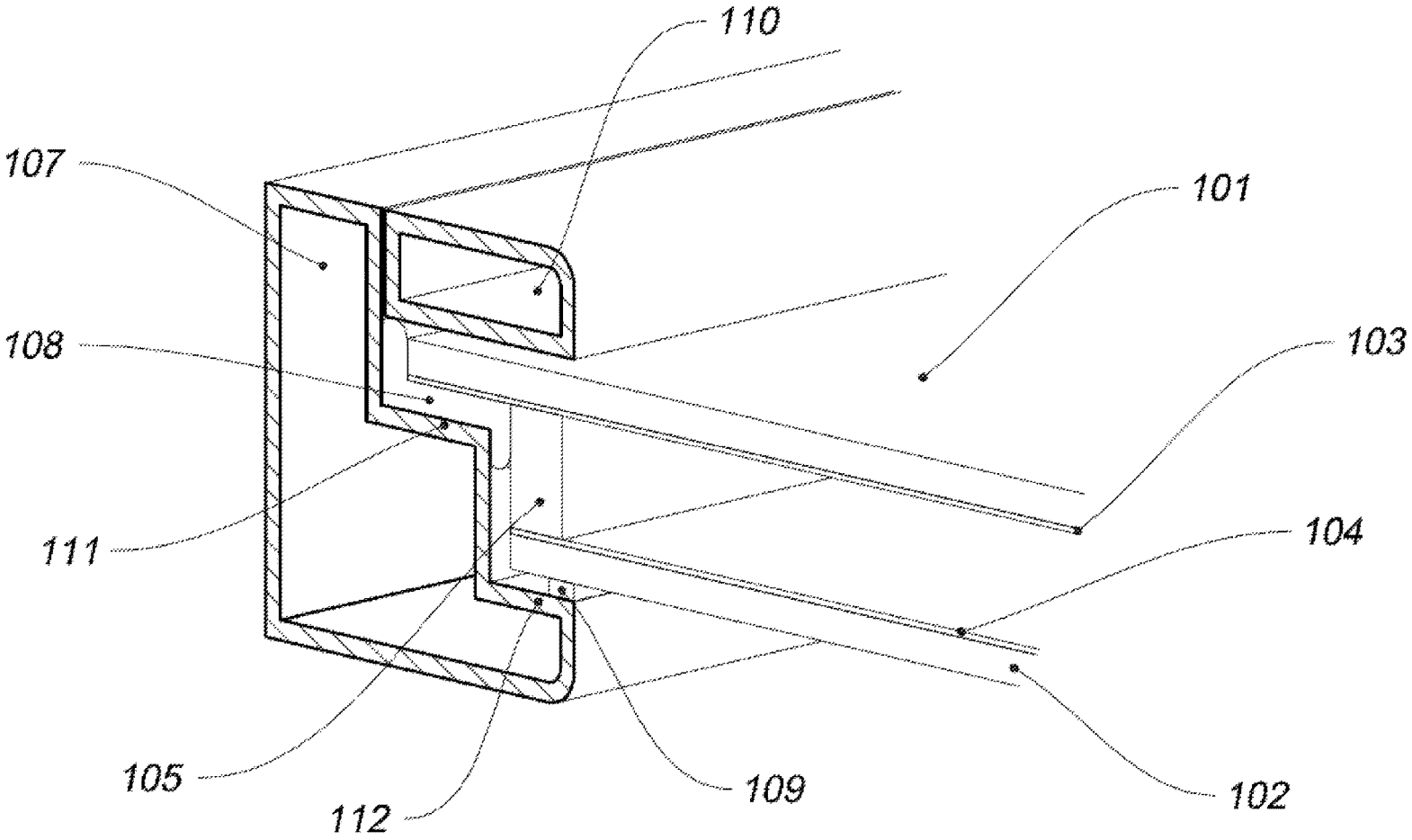
FIG. 2 depicts a perspective view of an impact-resistant fenestration with offset dual-pane insulated glass unit, according to embodiments described herein.
Figure 3:
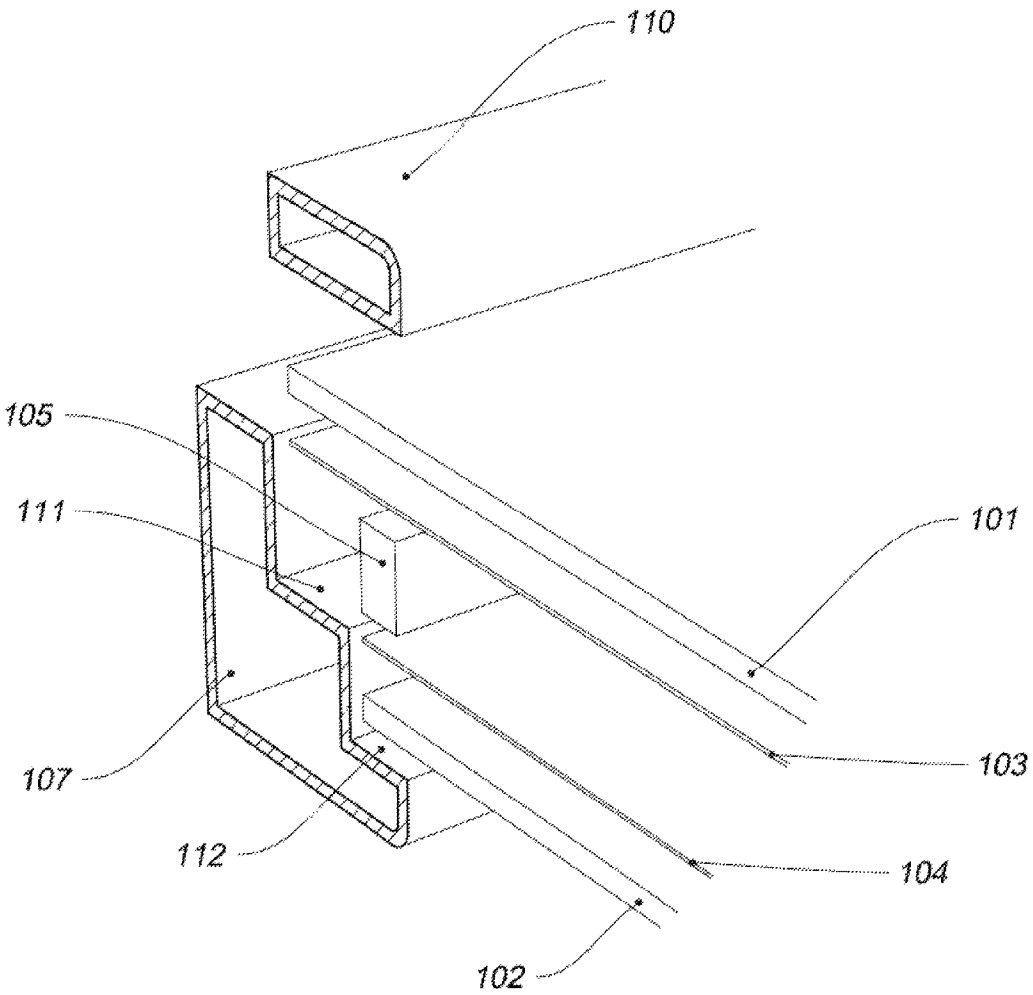
FIG. 3 depicts an exploded view of an impact-resistant fenestration with offset dual-pane insulated glass unit, according to embodiments described herein.

FIGS. 1-3 depict an impact-resistant fenestration with offset dual-pane insulated glass unit (IGU), according to embodiments described herein. The offset dual-pane insulated glass unit (IGU) 150 can be constructed using a large pane of glass 101 and a small pane of glass 102. The large pane 101 and small pane 102 can be substantially the same shape The small pane 102 can have lesser surface area than the large pane 101, such that there can exist an overhang section (denoted by dotted lines, 113) where the small pane 102 does not overlap the large pane 101. Put another way, the large pane 101 can have a greater surface area than the small pane 102, such that there can exist an overhang section (denoted by dotted lines, 113) where the small pane 102 does not overlap the large pane 101.

The large pane 101, the small pane 102, or both the large and small panes can be coated with an impact-resistant film 104. The impact-resistant film can be made of materials including, but not limited to, polyurethane, polyvinyl butyral, or polyethylene terephthalate (PET), ionoplast, liquid resin, epoxy-liquid crystal polymers, or a combination thereof. The impact-resistant film can at least be translucent or transparent. To reduce infrared leakage through the IGU 150, either the large pane 101 or the small pane 102 can have an additional coating of low emission (LowE) material 103. LowE material 103 can be a microscopic layer of silver deposited onto a substrate, such as glass or impact-resistant film, or another material that substantially reduces infrared transmissivity while allowing visible light transmission. LowE material 103 can increase the reflectivity of the glass, which can lead to more energy efficient fenestrations.

With or without impact-resistant film 104 and with or without LowE material 103, the small pane 102 and large pane 101 can be secured together such that an airspace 106 is present between the small pane 102 and the large pane 101. To create the airspace 106, an insulated glass spacer 105 can be used to separate the large pane 101 and the small pane 102, and can be secured to the panes using standard adhesives. The large pane 101 and small pane 102 can be secured together such that combined unit, the IGU 150, has a uniform overhang section 113 where the large pane 101 does not overlap with the small pane 102. The small pane 102 can be mounted centrally on the large pane 101 to create the uniformity of the overhang section 113.

Figure 5B:
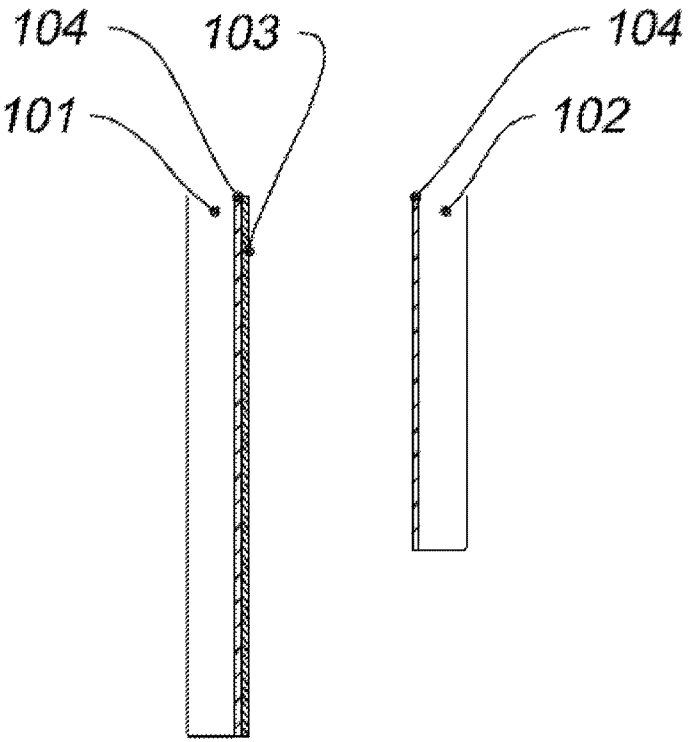
FIG. 5B depicts a permutation of an offset dual-pane insulated glass unit's large pane, small pane, impact-resistant film, and LowE coating, according to embodiments described herein.
Figure 5A:
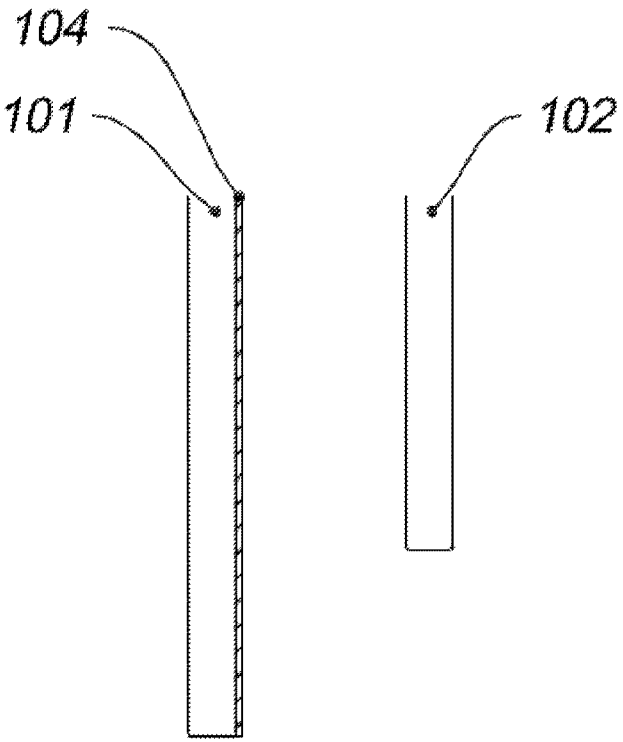
FIG. 5A depicts a permutation of an offset dual-pane insulated glass unit's large pane, small pane, impact-resistant film, and LowE coating, according to embodiments described herein.
Figure 5D:
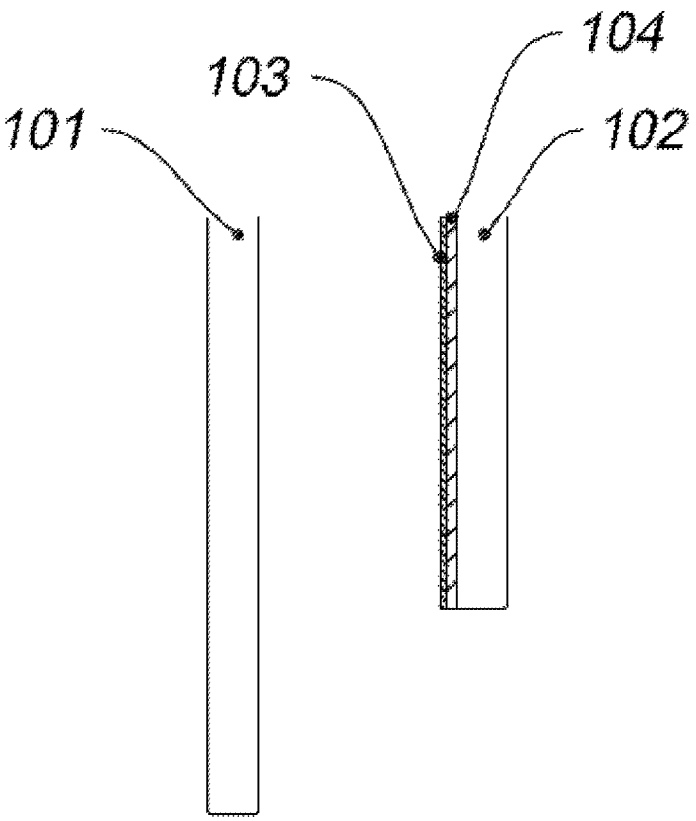
FIG. 5D depicts a permutation of an offset dual-pane insulated glass unit's large pane, small pane, impact-resistant film, and LowE coating, according to embodiments described herein.
Figure 5C:
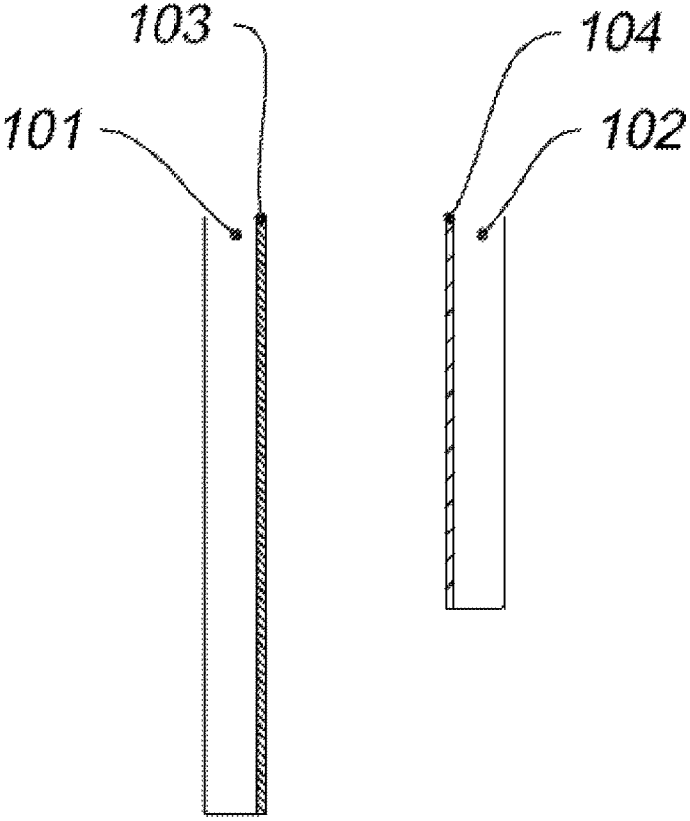
FIG. 5C depicts a permutation of an offset dual-pane insulated glass unit's large pane, small pane, impact-resistant film, and LowE coating, according to embodiments described herein.
Figure 5F:
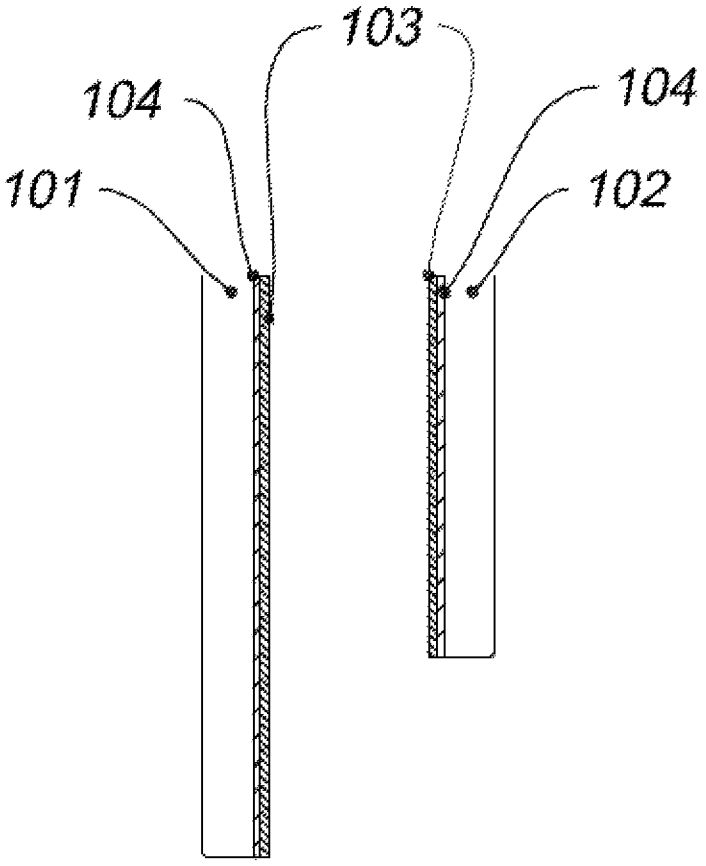
FIG. 5F depicts a permutation of an offset dual-pane insulated glass unit's large pane, small pane, impact-resistant film, and LowE coating, according to embodiments described herein.
Figure 5E:
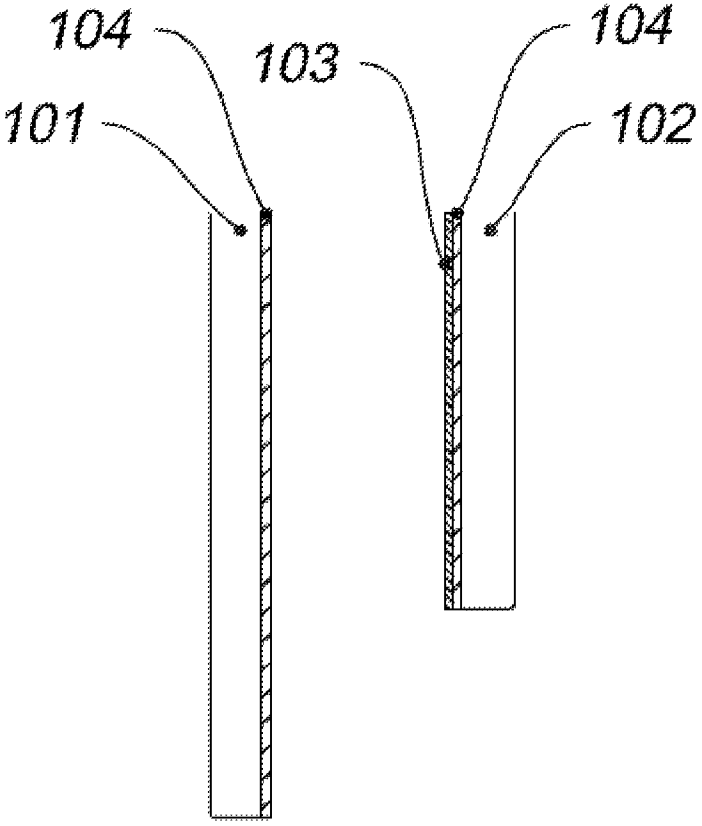
FIG. 5E depicts a permutation of an offset dual-pane insulated glass unit's large pane, small pane, impact-resistant film, and LowE coating, according to embodiments described herein.
Figure 5H:
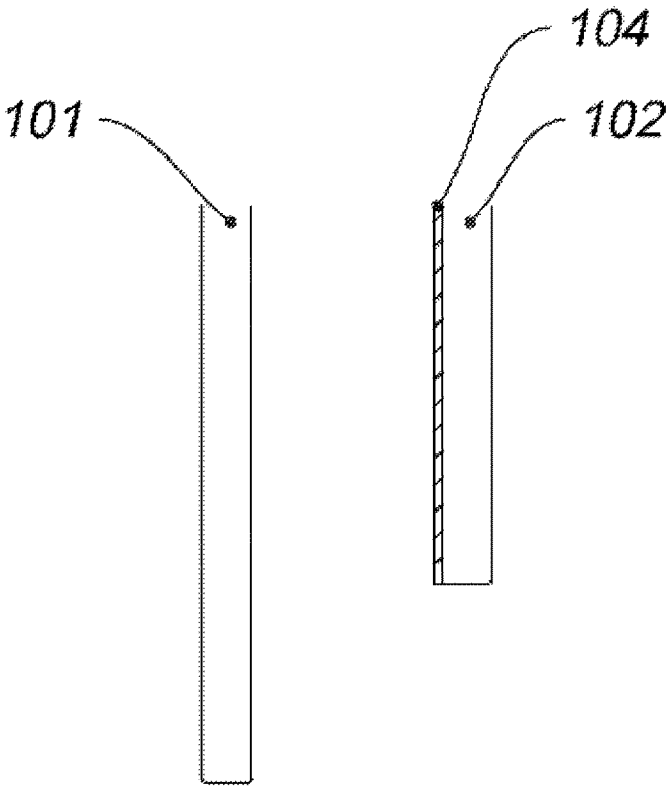
FIG. 5H depicts a permutation of an offset dual-pane insulated glass unit's large pane, small pane, impact-resistant film, and LowE coating, according to embodiments described herein.
Figure 5G:
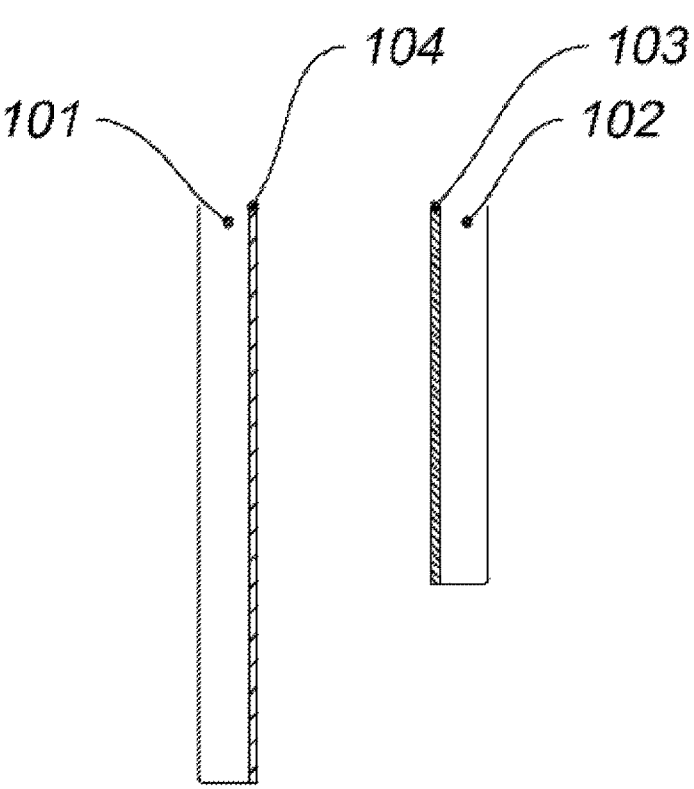
FIG. 5G depicts a permutation of an offset dual-pane insulated glass unit's large pane, small pane, impact-resistant film, and LowE coating, according to embodiments described herein.
Figure 5I:
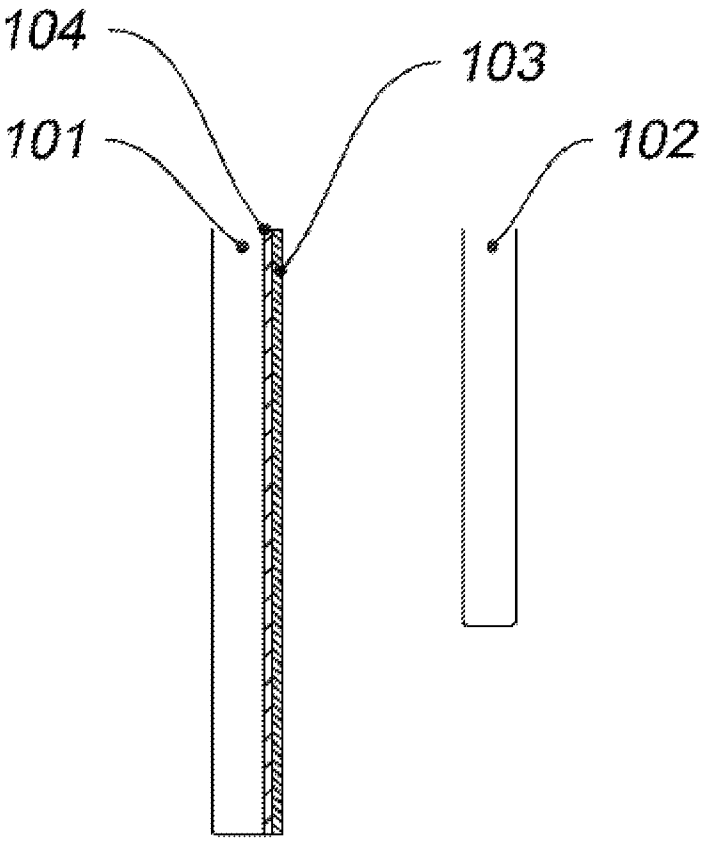
FIG. 5I depicts a permutation of an offset dual-pane insulated glass unit's large pane, small pane, impact-resistant film, and LowE coating, according to embodiments described herein.

FIGS. 5A-5I illustrate possible permutations of the order of panes, impact-resistant film, and LowE material within the IGU 150. In an embodiment, a permutation can be: large pane 101 with impact-resistant film 104, airspace, small pane 102 (FIG. 5A). In an embodiment, a permutation can be: large pane 101 with impact-resistant film 104 and LowE material 103, airspace, small pane 102 with impact-resistant film 104 (FIG. 5B). In an embodiment, a permutation can be: large pane 101 with LowE material 103, airspace, small pane 102 with impact-resistant film 104 (FIG. 5C). In an embodiment, a permutation can be: large pane 101, airspace, small pane 102 with impact-resistant film 104 and LowE material 103 (FIG. 5D). In an embodiment, a permutation can be: large pane 101 with impact-resistant film 104, airspace, small pane 102 with impact-resistant film 104 and LowE material 103 (FIG. 5E). In an embodiment, a permutation can be: large pane 101 with impact-resistant film 104 and LowE material 103, airspace, small pane 102 with impact-resistant film 104 and LowE material 103 (FIG. 5F). In an embodiment, a permutation can be: large pane 101 with impact-resistant film 104, airspace, small pane 102 with LowE material 103 (FIG. 5G). In an embodiment, a permutation can be: large pane 101, airspace, small pane 102 with impact-resistant film 104 (FIG. 5H). In an embodiment, a permutation can be: large pane 101 with impact-resistant film 104 and LowE material 103, airspace, small pane 102 (FIG. 5I). In an embodiment, any coating of LowE material 103 can face the airspace 106.

The impact-resistant fenestration can have a tiered frame (also referred to as a vent or sash) 107, into which the IGU 150 can be mounted. The tiered frame 107 can have an overhang mount 111 and a standard mount 112, which can be oriented in a terraced manner such that the overhang mount 111 can be disposed at a distance from the standard mount 112 equal to the length of the overhang section 113 of the IGU 150. The IGU 150 can be mounted into the frame 107 such that the overhang section 113 attaches to the overhang mount 111 though a layer of overhang adhesive 109, which can be shaped to conform with the overhang mount 111 such that a maximal amount of adhesion to the overhang section 113 can be achieved. The standard mount 112 can also have a layer of standard adhesive 108 attached, which can be the same type of adhesive as the overhang adhesive 109. The adhesive materials used can include, but are not limited to, glue, silicone, polyurethane, tape, epoxy, or a combination thereof. The small pane 101 can be adhered to the standard mount 112 through the standard adhesive 108. To secure the IGU 150 on the tiered frame 107, a glass stop (also known as a bead) 110 can be applied to the tiered frame 107 across the portion of the large pane 101 that forms the overhang section 113.

Figure 4:
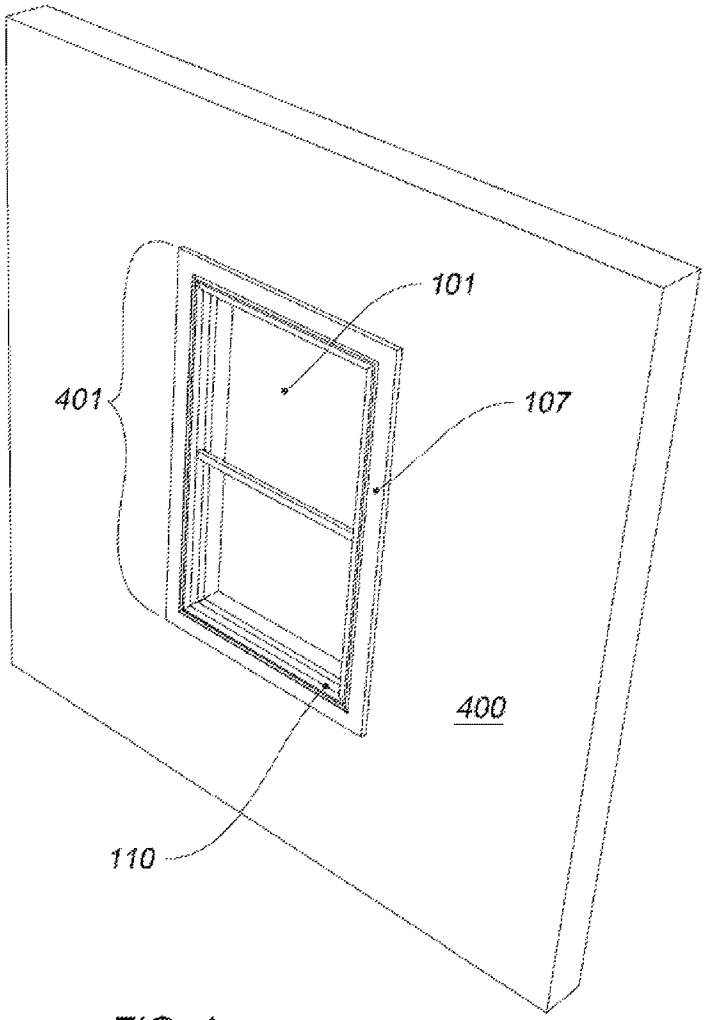
FIG. 4 depicts a perspective view of an impact-resistant fenestration with offset dual-pane insulated glass unit embedded in a structure element, according to embodiments described herein.

FIG. 4 illustrates an impact-resistant fenestration as mounted within a structure. While a rectangular example of an impact-resistant fenestration is shown in FIG. 4, a fenestration of any shape can be created using the technology disclosed herein. In an embodiment, the impact-resistant fenestration 401 can be mounted within a structure element 400. A structure element 400 can be a wall, door, or other area where a fenestration may be desired. The impact-resistant fenestration 401 can be mounted such that the large pane 101 can face the outside of the structure or the structure element. Outside can be defined as outdoors or by the area not defined by the perimeter of the structure.

Additionally, the glass stop 110 and the tiered frame 107 can be positioned such that the large pane 101, an element of the larger IGU, can face outwards. During an impacting event, such as a hurricane or other high-wind weather phenomenon, a projectile can travel at high velocities towards the outer surface of the structure. Upon striking the impact-resistant fenestration 401, the projectile's forward velocity can be halted due to the presence of the impact-resistant film on the large pane 101 and/or small pane (not shown). Additionally, the overhang section transfers can transfer the impact force of the projectile into the tiered frame, which in turn transfers the impact force to the structure element. The force transference, coupled with the impact-resistant film, can defer the velocity of the projectile to a sufficient degree such that the IGU can remain unbreached, which prevents further damage to the structure caused by the entrance of high winds and/or weather.

The present description and claims may make use of the terms "a," "at least one of," and "one or more of," with regard to particular features and elements of the illustrative embodiments. It should be appreciated that these terms and phrases are intended to state that there is at least one of the particular feature or element present in the particular illustrative embodiment, but that more than one can also be present. That is, these terms/phrases are not intended to limit the description or claims to a single feature/element being present or require that a plurality of such features/elements be present. To the contrary, these terms/phrases only require at least a single feature/element with the possibility of a plurality of such features/elements being within in the scope of the description and claims.

In addition, it should be appreciated that the following description uses a plurality of various examples for various elements of the illustrative embodiments to further illustrate example implementations of the illustrative embodiments and to aid in the understanding of the mechanisms of the illustrative embodiments. These examples are intended to be non-limiting and are not exhaustive of the various possibilities for implementing the mechanisms of the illustrative embodiments. It will be apparent to those of ordinary skill in the art in view of the present description that there are many other alternative implementations for these various elements that may be utilized in addition to, or in replacement of, the example provided herein without departing from the spirit and scope of the present invention.

The system and processes of the figures are not exclusive. Other systems, processes and menus may be derived in accordance with the principles of embodiments described herein to accomplish the same objectives. It is to be understood that the embodiments and variations shown and described herein are for illustration purposes only. Modifications to the current design may be implemented by those skilled in the art, without departing from the scope of the embodiments. As described herein, the various systems, subsystems, agents, managers and processes can be implemented using hardware components, software components, and/or combinations thereof. No claim element herein is to be construed under the provisions of 35 U.S.C. 112, sixth paragraph, unless the element is expressly recited using the phrase "means for."

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. An impact-resistant fenestration, comprising:

an offset dual-pane insulated glass unit, comprising:

a small pane;

a large pane comprising an outer edge and an overhang section, wherein the large pane has a greater surface area than the small pane;

a layer of impact-resistant film, having the same dimensions as the large pane, attached to the large pane;

wherein the small pane and the large pane are secured together using an insulated glass spacer to create an airspace between the small pane and large pane;

wherein the small pane is centrally secured on the large pane to create the overhang section; and wherein the small pane and the large pane are secured together such that the layer of impact-resistant film attached to the large pane is partially contained within the airspace and extends into the overhang section;

a tiered frame comprising an overhang mount, an overhang support extending from the overhang mount, and a tiered mount; and a glass stop;

wherein the offset dual-pane insulated glass unit is mounted into the tiered frame such that the overhang section of the offset dual-pane insulated glass unit is secured to the overhang mount and the overhang support of the tiered frame using a layer of overhang adhesive, the small pane of the offset dual-pane insulated glass unit is secured to the standard mount of the tiered frame using a layer of standard adhesive, and the glass stop attaches to the overhang section and is mounted on the overhang support of the tiered frame, wherein the insulated glass spacer is secured to the tiered frame with the layer of overhang adhesive, and wherein the layer of overhang adhesive includes an S-shape which conforms to the shape of the tiered frame to secure the overhang section and the insulated glass spacer to the tiered frame with the overhang adhesive in contact with the outer edge, the overhang section, and the insulated glass spacer.

2. The impact-resistant fenestration as recited in claim 1, further comprising:

a layer of LowE material attached to the layer of impact-resistant film such that the LowE material is disposed between the layer of impact-resistant film and the airspace.

3. The impact-resistant fenestration as recited in claim 1, further comprising:

a second layer of impact-resistant film attached to the small pane.

4. The impact-resistant fenestration as recited in claim 3, further comprising:

a layer of LowE material attached to the second layer of impact-resistant film such that the LowE material is disposed between the second layer of impact-resistant film and the airspace.

5. The impact-resistant fenestration as recited in claim 1, wherein the layer of impact-resistant film comprises at least one of polyurethane, polyvinyl butyral, or polyethylene terephthalate (PET), ionoplast, liquid resin, epoxy-liquid crystal polymers, and a combination thereof.

6. The impact-resistant fenestration as recited in claim 1, wherein the layer of overhang adhesive and the layer of standard adhesive comprise at least one of glue, silicone, polyurethane, tape, epoxy, and a combination thereof.

7. The impact-resistant fenestration as recited in claim 1, wherein the insulated glass spacer is positioned at an end surface of the small pane.

8. The impact-resistant fenestration as recited in claim 7, wherein the insulated glass spacer flush with the end surface of the small pane.

9. The impact-resistant fenestration as recited in claim 1, wherein the overhang support is perpendicular to the overhang mount and extends past an edge of the large pane to support the glass stop.

10. The impact-resistant fenestration as recited in claim 9, wherein the layer of overhang adhesive includes a portion between the large pane and the overhang mount and a potion between the edge of the large pane and the overhang support.

11. A method for manufacturing an impact-resistant fenestration, comprising:

assembling an offset dual-pane insulated glass unit, comprising:

applying a layer of impact-resistant film attached to a large pane having a greater surface area than a small pane, wherein the layer of impact-resistant film has the same dimensions as the large pane, and wherein the large pane comprises an overhang section and an outer edge; and securing the small pane centrally on the large pane to create the overhang section using an insulated glass spacer to create an airspace between the small pane and large pane, wherein the small pane and the large pane are secured together such that the layer of impact-resistant film attached to the large pane is partially contained within the airspace and extends into the overhang section;

mounting the offset dual-pane insulated glass unit on a tiered frame, comprising:

securing the overhang section of the offset dual-pane insulated glass unit to an overhang mount and an overhang support of the tiered frame using a layer of overhang adhesive;

securing the insulated glass spacer to the tiered frame with the layer of overhang adhesive; and securing the small pane of the offset dual-pane insulated glass unit to a standard mount of the tiered frame using a layer of standard adhesive; and attaching a glass stop to the overhang section and the overhang support of the tiered frame, wherein the layer of overhang adhesive includes an S-shape which conforms to the shape of the tiered frame to secure the overhang section and the insulated glass spacer to the tiered frame with the overhang adhesive in contact with the outer edge, the overhang section, and the insulated glass spacer.

12. The method as recited in claim 11, further comprising:

applying a layer of LowE material to the layer of impact-resistant film such that the LowE material is disposed between the layer of impact-resistant film and the airspace.

13. The method as recited in claim 11, further comprising:

applying a second layer of impact-resistant film attached to the small pane.

14. The method as recited in claim 13, further comprising:

applying a layer of LowE material to the second layer of impact-resistant film such that the LowE material is disposed between the second layer of impact-resistant film and the airspace.

15. The method as recited in claim 11, wherein the layer of impact-resistant film comprises at least one of polyurethane, polyvinyl butyral, or polyethylene terephthalate (PET), ionoplast, liquid resin, epoxy-liquid crystal polymers, and a combination thereof.

16. The method as recited in claim 11, wherein the layer of overhang adhesive and the layer of standard adhesive comprise at least one of glue, silicone, polyurethane, tape, epoxy, and a combination thereof.

17. The method as recited in claim 11, further comprising:

installing the impact-resistant fenestration into a structure element such that the large pane of the impact-resistant fenestration is on the exterior of the structure.

* * * * *